United States Patent [19]

Paspek

[11] Patent Number: 4,840,725

[45] Date of Patent: Jun. 20, 1989

[54] CONVERSION OF HIGH BOILING LIQUID ORGANIC MATERIALS TO LOWER BOILING MATERIALS

[75] Inventor: Stephen C. Paspek, North Royalton, Ohio

[73] Assignee: The Standard Oil Company, Cleveland, Ohio

[21] Appl. No.: 64,919

[22] Filed: Jun. 19, 1987

[51] Int. Cl.[4] ..... C10G 29/02; C10G 35/02

[52] U.S. Cl. ..... 208/130; 208/106; 208/952

[58] Field of Search ..... 208/952, 106, 130; 196/134

[56] References Cited

U.S. PATENT DOCUMENTS

| | | | |
|---|---|---|---|
| 1,956,567 | 5/1934 | Ellis | 196/134 |
| 1,956,603 | 5/1934 | White | 196/134 |
| 2,035,120 | 3/1936 | Forrest et al. | 196/134 |
| 2,135,332 | 11/1938 | Gary | 15/104.3 G |
| 2,665,238 | 1/1954 | Truitt et al. | 208/428 |
| 3,051,644 | 8/1962 | Friedman et al. | 208/11 |
| 3,453,206 | 1/1969 | Gatsis | 208/210 |
| 3,501,396 | 3/1970 | Gatsis | 208/216 |
| 3,579,438 | 5/1971 | Gruse | 208/130 |
| 3,586,621 | 6/1971 | Pitchford et al. | 208/112 |
| 3,676,331 | 7/1972 | Pitchford | 208/112 |
| 3,733,259 | 5/1973 | Wilson et al. | 208/86 |
| 3,948,754 | 4/1976 | McCallum et al. | 208/11 |
| 3,989,618 | 11/1976 | McCallum et al. | 208/106 |
| 4,005,005 | 1/1977 | McCallum et al. | 208/11 |
| 4,428,828 | 1/1984 | Base | 208/208 R |
| 4,446,012 | 5/1984 | Murthy et al. | 208/130 |
| 4,453,177 | 6/1984 | Berger et al. | 358/44 |
| 4,483,761 | 11/1984 | Paspek | 208/106 |
| 4,559,127 | 12/1985 | Paspek | 208/8 LE |
| 4,594,141 | 6/1986 | Paspek et al. | 208/390 |
| 4,604,188 | 8/1986 | Yan et al. | 208/106 |

FOREIGN PATENT DOCUMENTS 3201719 1/1982 Fed. Rep. of Germany .

*Primary Examiner*—Glenn Caldarola

*Attorney, Agent, or Firm*—L. W. Evans; J. G. Curatolo; T. W. Gilbert

[57] ABSTRACT

An improvement in the conversion of high boiling liquid organic materials to low boiling materials, and more particularly, in the process of converting heavy hydrocarbon oil feedstocks to fuel range liquids is described. In its broadest aspects, the invention comprises a process for converting high boiling hydrocarbons to lower boiling materials characterized by an increase in aromatic content and a lower pour point which comprises contacting said high boiling hydrocarbons with water at a temperature of from about 600° F. to about 875° F. at a pressure of at least about 2000 psi in the absence of any externally supplied catalysts, and wherein the weight ratio of water to high boiling hydrocarbons is from about 0.5:1 to about 1:1, and the water and high boiling hydrocarbon form a substantially single phase system under the elevated temperature and pressure conditions utilized.

19 Claims, No Drawings

CONVERSION OF HIGH BOILING LIQUID ORGANIC MATERIALS TO LOWER BOILING MATERIALS

TECHNICAL FIELD OF THE INVENTION

This invention relates to a process for the conversion of heavy hydrocarbons to lower boiling materials, and in particular, to lower boiling materials characterized by increased aromaticity, a lower pour point and generally higher octane number.

BACKGROUND OF THE INVENTION

The potential reserves of liquid hydrocarbons which are contained in subterranean carbonaceous deposits have been identified as being substantial. Tar sands and oil shales represent two of the major potential resources of oil. In fact, the potential reserves of liquid hydrocarbons to be derived from tar sands and oil shales is believed to exceed the known reserves of liquid hydrocarbons to be derived from petroleum. However, the exploration of these potential reserves has been limited by the previously low priced and abundant supply of liquid crude oil and the process difficulties of (a) extracting the heavier more viscous organic materials from tar sands and oil shales, and (b) converting the heavier materials to fuel range liquids.

More recently, however, because of the threat of increased costs of liquid crude oils and the ever present threat of reduced availability from foreign sources, there is significant interest in improving the economics of recovering liquid hydrocarbons and in particular, fuel range liquids from heavy hydrocarbon sources on a commercial scale. Methods have been suggested for recovering hydrocarbons from tar sands and oil shales, but the methods generally have not been accepted because of their high costs which renders recovered hydrocarbons too expensive to compete with petroleum crudes which can be recovered by more conventional methods. Heavy crude oils such as the California, Alaskan and Venezuelan crudes are difficult to transport through pipelines because of their high viscosity and pour points. Improved methods for reducing the pour points and the viscosity of heavy crude oils are desirable since lower viscosity results in higher pipeline throughput with less pressure drop and reduced energy consumption.

The extraction of oil from tar sands and oil shales requires a physical separation process to break the oil/-sand or shale bond. Techniques include the use of hot water, steam and/or hot gases. Such a process requires high temperatures.

The crude oil produced from both tar sands and oil shales requires further processing to convert it to an acceptable refinery feedstock. The tar sands crude is a heavy extremely viscous high sulfur crude generally requiring that it be coked and hydrogenated or alternatively, hydrocracked. The oil recovered from shale retorts is similar to conventional crudes in some respects and is extremely viscous and contains a high nitrogen content.

The value of the hydrocarbons which have been recovered from oil shale and tar sands also has been diminished due to the presence of certain contaminants such as sulfur, nitrogen, and metallic compounds which have a negative effect on the catalyst utilized in many of the processes to which the recovered hydrocarbons may be subjected. The contaminants also are undesirable because of their disagreeable odor, corrosive characteristics and combustion products.

Petroleum oil fractions produced by atmospheric or vacuum distillation of crude petroleum also are characterized by relatively high concentrations of metals, sulfur and nitrogen. The high level of impurity results because substantially all of the contaminants present in the original crude remain in the residual fraction. The high metals content of the residual fractions generally preclude their effective use as charge stocks for subsequent catalytic processing because the metal contaminants deposit on the special catalyst for the processes and also result in the formation of inordinant amounts of coke, dry gas and hydrogen. For example, the delayed coking process has been effected on heavy residium fuels to obtain lower boiling cracked products. The process is considered a high severity thermal cracking process and yields large amounts of coke by-product.

Methods have been suggested for recovering liquid hydrocarbon fractions from various carbonaceous deposits utilizing water and in particular, supercritical water which results in increased yields of distillate and decreased levels of coke relative to straight pyrolysis. U.S. Pat. No. 3,051,644 discloses a process for the recovery of oil from oil shale which involves subjecting the oil shale particles dispersed in steam to treatment with steam at temperatures in the range of from about 370° C. to about 485° C., and at a pressure in the range from about 1000 to 3000 psi. Oil from the oil shale is withdrawn in vapor form and admixed with steam. In U.S. Pat. No. 2,665,238, a process is described for recovering oil from oil shale which involves treating the shale with water in a large amount approaching the weight of the shale at a temperature in excess of 260° C. and under a pressure in excess of 1000 psi. The amount of oil recovered increases generally as the temperature or pressure is increased.

U.S. Pat. No. 1,956,567 describes a process for aquolyzing petroleum products such as heavy hydrocarbons wherein the proportion of water that is used is considerably in excess of the proportion of oil that is used. The temperature and pressure in the reaction zone are above the critical temperature and pressure for water. U.S. Pat. No. 2,035,120 describes a process for converting heavy oil to light oils by treating oil with a large excess of water at high pressures and at temperatures above the critical temperature. U.S. Pat. No. 1,956,603 also relates to the aquolyzing of petroleum products, but the process described in this patent uses less water. The process of the '603 patent involves forming an emulsion of the heavy oil in water containing at least 50% water, and subjecting the emulsion to temperatures between 1000–1250° F. at a pressure of about 200 atmospheres.

U.S. Pat. No. 2,135,332 describes a conversion of hydrocarbon oil to lighter hydrocarbons by subjecting the oil and a diluent gas (water or steam) to temperatures in the order of 960–975° F. or more and pressures preferably about 2000 to 3000 psi. The amount of diluent gas should be in excess of 10% by weight of the original charging stock and preferably considerably more.

U.S. Pat, No. 3,989,618 describes a process for upgrading a hydrocarbon fraction by contacting the hydrocarbon fraction with a dense-water-containing fluid at a temperature in the range of 600–900° F. in the absence of any externally supplied catalyst and hydrogen. The water-containing fluid used in the process has a density of at least 0.10 gram per milliliter and the fluid serves as an effective solvent for the hydrocarbon fraction. The process described in the '618 patent also is reported to be useful for recovering upgraded hydrocarbons from tar sand solids in U.S. Pat. No. 4,005,005.

U.S. Pat. No. 4,428,828 describes a process for upgrading oils in which the oil is contacted with liquid phase water and free oxygen at a temperature above 175° C. and at a pressure sufficient to maintain at least part of the water in the liquid phase. The temperature generally is in the range of from 175°-300° C., and the aqueous liquid:hydrocarbon oil volume ratio may be from 0.5:1 up to about 10:1.

U.S. Pat. No. 4,604,188 describes the procedure for thermally upgrading residual oils by heating the oils with steam at a temperature of 650°-900° F. and 0-100 psig. The steam to residual oil ratio is 0.01 to 10, preferably from 0.1 to 1.

U.S. Pat. Nos. 4,483,761; 4,594,141; and 4,559,127 describe procedures for upgrading heavy hydrocarbons with supercritical water and various catalysts or promoters.

A procedure for the extraction of oil from shale and tar sands by supercritical water preferably containing dissolved salts is described in DE3201719(A). Temperatures of from 360°-600° C. and pressures of 130-700 atmospheres are described as being used, and the water preferably contains one or more dissolved salts, especially alkali, alkaline earth or ammonium chlorides or carbonates.

SUMMARY OF THE INVENTION

An improvement in the conversion of high boiling liquid organic materials to low boiling materials, and more particularly, in the process of converting heavy hydrocarbon oil feedstocks to fuel range liquids is described. In its broadest aspects, the invention comprises a process for converting high boiling hydrocarbons to lower boiling materials characterized by an increase in aromatic content and a lower pour point which comprises contacting said high boiling hydrocarbons with water at a temperature of from about 600° F. to about 875° F. at a pressure of at least about 2000 psi in the absence of any externally supplied catalysts, and wherein the weight ratio of water to high boiling hydrocarbons is from about 0.5:1 to about 1:1, and the water and high boiling hydrocarbon form a substantially single phase system under the elevated temperature and pressure conditions used.

DESCRIPTION OF THE PREFERRED EMBODIMENTS

It now has been found that the process for forming and recovering low boiling materials from high boiling liquid organic materials such as heavy crude oil, tar and shale oil, as well as petroleum and heavy hydrocarbon oil fractions utilizing water and high temperatures and pressures can be improved by regulating the amount of water present and the temperature of the reaction within rather narrow limits.

In accordance with the present invention, high boiling organic materials are contacted with water in a weight ratio of from about 0.5:1 to about 1:1 at a temperature of from about 600° F. to about 875° F. at a pressure of at least about 2000 psi forming a substantially single phase system for a period of time to provide the desired conversion of the high boiling materials to lower boiling materials. The single phase system is then allowed to form an aqueous phase and an organic phase usually by reducing the temperature, or pressure or both. The organic phase contains the desirable low boiling organic materials which can be recovered by known techniques. The recovered low boiling materials contain increased amounts of aromatics and the recovered materials are characterized by a lower pour point and a generally higher octane number.

The high boiling organic materials which can be subjected to the process of the invention include, for example, heavy crude oil, petroleum, shale oil, tar, tar sand oil, bitumen, kerogen, coal liquids and other heavy hydrocarbon oils. The high boiling organic materials which can be treated in accordance with the process of the invention generally are those with an I.B.P. of at least about 200° C.

The process of the present invention is useful particularly on heavy crude oil, residual petroleum oil fractions, shale oil, tar sand oil, bitumen, coalderived hydrocarbons and other heavy hydrocarbon oils. All of these organic materials generally are characterized by relatively high boiling point and high metal, sulfur and nitrogen content. Principal metal contaminants include nickel, vanadium, iron and copper. Heavy crude oils comprise a significant potential source of useful materials and these are found for example in the California crudes, Alaskan crudes and Venezualan crudes. Heavy crude oils are generally defined as those having an API gravity of below about 10-20.

The conversion of high boiling organic materials to lower boiling organic materials effected by the process of the invention generally is referred to in the prior art as a cracking process, and this aspect of the process of the invention generally will be referred to hereinafter as cracking. More particularly, cracking is the chemical conversion of the hydrocarbons present in the organic materials into lighter, more useful hydrocarbon fractions such as fuel range liquids.

As noted, the process of the present invention is conducted in the presence of water under supercritical conditions, and the mixture of high boiling organic material and water is substantially a single phase system under the reaction conditions. At room temperature and atmospheric pressure, the high boiling liquid organic materials and water are not fully miscible. However, the high boiling organic materials are readily miscible in water at elevated temperatures and pressures, especially those near the critical temperature and pressure of water. Accordingly, temperatures and pressures approaching or greater than the critical temperature and pressure for water are most suitable for the process. Generally, the reaction will be conducted at a temperature of at least about 600° F. and up to about 875° F. at a pressure of at least about 2000 psi. A practical upper limit on the pressure is about 10,000 psi. If the temperature exceeds 875° F., excessive amounts of coke are formed. In one embodiment, the reaction temperature is maintained between 700° F. and 850° F., and in another embodiment, the temperature is maintained between about 800° F. to about 850° F. Although pressures of between about 2000 to about 10,000 psi may be utilized, the reaction generally will be conducted at pressures of between about 4000 to about 6000 psi.

An important and critical feature of the process of the present invention is the weight ratio of water to high boiling hydrocarbons contained in the reaction mixture. The weight ratio of water to high boiling hydrocarbons may vary from about 0.5:1 to about 1:1 although increasing the weight ratio to greater than 0.7:1 does not appear to be particularly beneficial. Thus, the preferred ratios are from 0.5:1 to about 0.7:1, and a most preferred ratio is about 0.5:1. When the water to hydrocarbon weight ratio is less than about 0.5, the reaction results in significant increases in coke and gas yields with concomitant decreases in the yield of the desired low boiling materials. Under the reaction conditions and at the water to hydrocarbon ratios specified, the water and high boiling hydrocarbon form a substantially single phase system.

The process of the present invention is carried out in the absence of externally supplied catalysts, and is generally conducted in the absence of reducing gases such as hydrogen.

The reaction is conducted generally for a period of time which is sufficient to provide the desired conversion of high boiling hydrocarbons to low boiling hydrocarbons. The time of the reaction will, of course, vary depending upon the temperature, pressure and the water to hydrocarbon weight ratio. For example, at the lower temperatures and pressures, the reaction time will be longer whereas at the higher temperatures and pressures, the time required to obtain the desired conversion is reduced. The three factors of temperature, pressure and time can be varied as determined by one skilled in the art. Depending on these factors, the reaction time may be as short as a few seconds, more generally from about one minute to about 6 hours. In one embodiment, the reaction time is from about one to about 120 minutes.

The process of the invention can be conducted either as a batch or continuous process. In a preferred embodiment, the weight ratio of water to high boiling organic material is typically from about 0.5:1 to about 0.7:1. The reaction temperatures preferably are in the range of from about 800° to 850° F., reaction pressures are in the range of about 4000 to 6000 psi, and the reaction times at the elevated temperatures and pressures are normally about one to about 50 minutes.

When a batch process is utilized, the high boiling organic material such as shale oil and the water are added to a reaction vessel such as an autoclave. The autoclave then is sealed and heated to the desired operating temperature and pressure (to form a substantially single phase medium), and when the operating temperature and pressure are reached, they are maintained for the allotted period of time to effect the desired cracking of the high boiling organic materials. Generally, a period of from about one minute to about 6 hours is adequate to provide the desired degree of conversion of high boiling materials to lower boiling materials. The reactor then is cooled, for example, to room temperature and the pressure is released whereupon the reaction mixture separates into an aqueous phase and an oil phase. The oil phase is separated from the aqueous phase and subjected to various techniques to isolate and recover the desired low boiling fractions such as by distillation or by chromatographic techniques.

When a continuous process is utilized, the reaction product obtained from the reactor is allowed to separate into two phases and the oil phase is recovered. The aqueous phase, as well as any residue recovered from the oil phase can be recycled to the reactor where the recycled organic material is, in effect, subject to a second cracking, and further conversion and recovery of desirable low boiling materials.

The process of the present invention has several advantages over some of the previously described prior art processes. The process of the invention produces desirable low boiling products and increased yields under relatively mild conditions. Moreover, the products obtained by the process of the invention contain increased amounts of high value aromatic carbons. Also, the amount of coke produced inside the reactor as the result of the process of the invention is reduced. The reduction of coke formation is a significant benefit since coke tends to foul conventional reactors, and where coke is produced, the reactors must be shut down regularly and cleaned. The reduction in the amount of coke formed means that these reactors are capable of being operated continuously for longer periods. Another advantage of the process of the invention is that the recovered lower boiling materials have lower pour points which facilitate handling and transportation, particularly through pipelines.

The following examples, except those identified as controls, illustrate the process of the invention. Unless otherwise indicated in the examples, or elsewhere in the specification and claims, all parts and percentages are by weight, temperatures are in degrees centigrade, and times are in minutes. Distillate and residual yields are reported as volume percent.

The experiments described below are conducted in a vertical tube reactor of about 400 cc. The water/hydrocarbon ratio is as reported. Reaction temperatures are 825° F. (440° C.), reaction pressures typically are from 4900 psi. The water and hydrocarbon are separately preheated and mixed in a high pressure feed pump just before being fed to the reactor. At the end of the reactor, the entire product passes through a condenser and separates into three phases: oil, gas and water. Solids are determined by difference in material balance. The oil is separated and analyzed for aromatic carbon content and pour point.

The results of a series of experiments conducted on shale oil as the high boiling liquid organic material are summarized in the following Table I. The shale oil used in the experiments has an aromatic carbon content of 12 mole percent and a pour point of about 85° F.

TABLE I

| Example | Water: Hydrocarbon Weight Ratio | Reaction Time (min) | Product: Aromatic Carbon Content (mole %) | Product: Pour Point (°F.) |
|---|---|---|---|---|
| 1 | 1:1 | 25 | 30 | −40 |
| 2 | 1:1 | 15 | 28 | 0 |
| 3 | 1:1 | 10 | 24 | 15 |
| 4 | 1:1 | 5 | 19 | 50 |
| 5 | 0.5:1 | 15 | 34 | −40 |
| 6 | 0.5:1 | 8 | 30 | −20 |

The results summarized in Table I demonstrate the improvement which is obtained in pour point and aromaticity when the water to hydrocarbon ratio is maintained within the range of 0.5:1 to 1:1 in the process of the invention. Particularly beneficial is the ratio of 0.5:1.

Although only a few embodiments of this invention have been described above, it should be appreciated that many additions and modifications can be made without departing from the spirit and scope of the invention. These and all other modifications are intended to be included within the scope of this invention which is to be limited only by the following claims.

I claim:

1. A process for converting high boiling hydrocarbons to lower boiling materials characterized by an increase in aromatic content and a lower pour point which comprises contacting said high boiling hydrocarbons with water at a temperature of from about 600° F. to about 875° F. at a pressure of at least about 2000 psi in the absence of any externally supplied catalysts, and wherein the weight ratio of water to high boiling hydrocarbons is from about 0.5:1 to about 0.7:1, and the water and high boiling hydrocarbon form a substantially single phase system under the elevated temperature and pressure conditions utilized.

2. The process of claim 1 wherein the high boiling hydrocarbon is a heavy hydrocarbon oil selected from the group consisting of shale oil, coal oil, bitumen or a heavy hydrocarbon oil.

3. The process of claim 1 wherein the temperature is from about 700° F. to about 850° F.

4. The process of claim 1 wherein the pressure is from about 2000 to about 10,000 psi.

5. The process of claim 1 wherein the temperature is from about 800° F. to about 850° F.

6. The process of claim 1 wherein the pressure is from about 4000 to about 6000 psi.

7. The process of claim 1 wherein the high boiling hydrocarbon is a heavy crude oil or crude oil distillation residue.

8. A process for converting high boiling hydrocarbons to lower boiling materials characterized by an increase in aromatic content and a lower pour point which comprises contacting said high boiling hydrocarbon with water at a temperature of from about 700° F. to about 875° F. at a pressure of from about 2000 to about 10,000 psi in the absence of any externally supplied catalyst wherein the weight ratio of water to high boiling hydrocarbon is from about 0.5:1 to about 0.7:1, and the high boiling hydrocarbon and water form a substantially single phase system under the elevated temperature and pressure conditions utilized.

9. The process of claim 8 wherein the high boiling hydrocarbon is shale oil, heavy crude oil or a crude oil distillation residue.

10. The process of claim 8 wherein the weight ratio of water to high boiling hydrocarbon is about 0.5:1.

11. The process of claim 8 wherein the temperature is from about 700° F. to about 850° F.

12. The process of claim 8 wherein the pressure is from about 4000 to about 6000 psi.

13. A process for recovering lower boiling materials characterized by an increase in aromatic content in a lower pour point from high boiling hydrocarbons which comprises the steps of (A) contacting the high boiling hydrocarbons with water at a temperature of from about 600° F. to about 875° F. at a pressure of from about 2000 to about 10,000 psi in the absence of any externally supplied catalysts for a period of time sufficient to provide a conversion of at least some of the high boiling hydrocarbons to lower boiling materials, and wherein the weight ratio of water to high boiling hydrocarbon is from about 0.5:1 to about 0.7:1, and the high boiling hydrocarbon and water form a substantially single phase system under the elevated temperature and pressure conditions utilized;

(B) allowing the mixture to form an aqueous phase and an organic phase; and (C) separating and recovering the organic phase from the aqueous phase.

14. The process of claim 13 wherein the heavy hydrocarbon oil is heavy crude oil, shale oil, coal oil, bitumen, a crude oil distillation residue 15. The process of claim 13 wherein the high boiling hydrocarbon is in contact with the water in step (A) for a period of time sufficient to convert at least a portion of the high boiling hydrocarbon to the desired lower boiling material.

16. The process of claim 13 wherein the pressure is from about 4000 to about 6000 psi.

17. The process of claim 13 wherein the mixture is allowed to form an aqueous phase and an organic phase in step (B) by reducing the pressure or the temperature or both.

18. The product obtained by the process of claim 1.

19. The organic phase obtained by the process of claim 13.

* * * * *